US008603366B2

(12) United States Patent
Hung et al.

(10) Patent No.: US 8,603,366 B2
(45) Date of Patent: Dec. 10, 2013

(54) ELECTRICAL CONTACT MATERIAL OF SILVER MATRIX CAPABLE OF RESISTING ARC EROSION AND CONTAINING NO CADMIUM-COMPOSITE

(75) Inventors: Chin-Wei Hung, Taichung County (TW); Wen-Yuan Chiang, Taipei County (TW); Wei-Chu Chen, Taipei County (TW); Chih-Jung Wang, Taiepi County (TW); Wen-Ying Cheng, Taipei County (TW); Bor-Chen Tsai, Taipei (TW); Wei-Chao Wang, Taipei County (TW)

(73) Assignee: C.C.P. Contact Probes Co., Ltd., Taipei County (TW)

( * ) Notice: Subject to any disclaimer, the term of this patent is extended or adjusted under 35 U.S.C. 154(b) by 463 days.

(21) Appl. No.: 12/955,113

(22) Filed: Nov. 29, 2010

(65) Prior Publication Data

US 2012/0132869 A1 May 31, 2012

(51) Int. Cl.

| | |
|---|---|
| ***H01B 1/02*** | (2006.01) |
| ***H01B 1/22*** | (2006.01) |
| ***C22C 29/12*** | (2006.01) |
| ***C22C 5/08*** | (2006.01) |

(52) U.S. Cl.

USPC ..... 252/514; 252/520.1; 252/520.3; 75/232; 75/234; 75/245; 420/502

(58) Field of Classification Search

USPC ..... 252/500, 514, 520.1, 520.3; 75/232, 75/234, 245; 420/502

See application file for complete search history.

(56) References Cited

U.S. PATENT DOCUMENTS

| | | | | | |
|---|---|---|---|---|---|
| 4,072,515 | A | * | 2/1978 | Motoyoshi et al. | 148/431 |
| 4,204,863 | A | * | 5/1980 | Schreiner | 75/234 |
| 4,450,135 | A | * | 5/1984 | Peters et al. | 419/12 |

* cited by examiner

*Primary Examiner* — Mark Kopec
*Assistant Examiner* — Tanisha Diggs
(74) *Attorney, Agent, or Firm* — Rosenberg, Klein & Lee

(57) ABSTRACT

In an electric contact material of silver matrix capable of resisting arc erosion and containing no cadmium-composite, an Ag—($SnO_2$+$In_2O_3$) composite containing 9~11% of ($SnO_2$+$In_2O_3$) or an Ag—Cu oxide, composite containing 15~25% of Cu oxide is used. The electrical contact material has a contact resistance of 5~60 milliohms (mohm) and an arc erosion resistance capability up to $2*10^3$~$10*10^3$ times provided that the Vickers hardness (Hv) of the material is 100~150, the measured current is 1~5 amperes, and the measured voltage is 10~20 volts. Two electrical contacts maintain an arc erosion resisting capability at the condition of a low contact resistance when the electrical contact material is formed on a surface of a metal substrate of an electric connector.

2 Claims, 4 Drawing Sheets

ELECTRICAL CONTACT MATERIAL OF SILVER MATRIX CAPABLE OF RESISTING ARC EROSION AND CONTAINING NO CADMIUM-COMPOSITE

BACKGROUND OF THE INVENTION

1. Field of the Invention

The present invention relates to electrical contact materials, and more particularly to an electrical contact material of silver matrix containing no cadmium-composite, and having the features of high hardness, high wear resistance and low contact resistance, while maintaining a better arc erosion resistance.

2. Description of the Related Art

At present, electrical contact material is used extensively in the different areas that require an electrical contact, such as communication transmission, system or power output control, electronic instrument connection, and computer peripherals, etc. In general, a phenomenon of producing an electric discharge usually occurs when an electric connector or a relay is turned on/off, since the distance between two electric contact is very small when they are about to contact with or separate from one another. Under an environment with a high electric field distribution, current between the two electric contacts produces such electric discharge phenomenon, which further causes the formation of an electric arc.

In general, a mass transfer of the materials usually occurs between two electrical contacts during an arc erosion process, and a protrusion or a recess is formed on a surface of the electrical contact, or a rough source is formed on the surface of the electrical contact after a metal is melted and solidified in the arc erosion, and other contaminations or damages caused by the aforementioned phenomena will destroy the smooth surface of the original electrical contact and increase the contact resistance, which will further affect the working performance of the electrical contact.

In practical applications, manufacturers of the related industry have been using platinum as a matrix material, but platinum incurs a high cost, and it is gradually replaced by copper. Although copper has the advantages of high electrical and thermal conductivities and a low cost, yet oxides may be fowled easily on the surface of copper, so that a silver matrix having the same advantages of copper is introduced and used as a matrix material. Although silver can resist oxidation, silver has the disadvantages of a lower strength, a lower wear resistance and a severer arc erosion phenomenon which are unfavorable for a long time use as an electrical contact material. At a later stage, a more economic CdO/Ag contact material was developed, and such contact material has the advantages of a high electrical conductivity, a high thermal conductivity, and a good erosion resistance, such that the CdO/Ag contact material can be used for conducting a larger current and applied to a heavy-duty or very large switch or relay. However, Cd is highly toxic, and the European Commission has officially banned electronic products using a highly toxic substance such as Cd and Pb through the WEEE and RoHS directives.

With reference to FIGS. 1A and 1B for schematic views showing the surface of a connector with a conventional AuCo electrical contact material gone through an arc erosion test for 500 times, the surface of the conventional electrical contact material is seriously damaged after the material has gone through the arc erosion test for 500 times, and thus resulting in a short lifespan and a poor performance of the electric contact material.

It is an important subject for manufacturers of the related industry to provide an electrical contact material in compliance with the international specification of a toxic-free material and having the advantages of high electrical conductivity, good erosion resistance, and high hardness to meet the aforementioned requirements.

SUMMARY OF THE INVENTION

Therefore, it is a primary objective of the present invention to provide an electrical contact material with a high hardness and a high wear resistance, while maintaining a higher arc erosion resistance at a lower contact resistance.

To achieve the foregoing objective, the present invention provides an arc erosion resisting silver matrix containing no cadmium-composite electric contact material, characterized in that the electrical contact material has a contact resistance of 5~60 milliohms (mohm) and an arc erosion resistance capability up to $2*10^3$~$10*10^3$ times at the conditions of a Vickers hardness (Hv) of 100~150, a measured current of 1~5 amperes and a measured voltage of 10~20 volts, and two electrical contacts maintain an arc erosion resisting capability at the condition of a low contact resistance when the electrical contact material is formed on a surface of a metal substrate of an electric connector.

The electrical contact material is comprised of an Ag—($SnO_2$+$In_2O_3$) composite, wherein the content of ($SnO_2$+$In_2O_3$) occupies 9~11% of the Ag—($SnO_2$+$In_2O_3$) composite.

The electrical contact material also can be comprised of an Ag—Cu oxide composite, wherein the content of Cu oxide occupies 15~25% of the Ag—Cu oxide composite.

The present invention provides an arc erosion resisting silver matrix containing no cadmium-composite electric contact material and in compliance the Waste Electrical and Electronic Equipment and Restrictions of Hazardous substance (RoHS) directives set forth by the European Commission (EC), and the electrical contact material also has the capability of conducting a large current and the advantages of a better erosion resistance and an enhanced hardness of the contact material to achieve the effects of reducing the arc erosion effect, providing a low contact resistance and enhancing the lifespan of the product.

DETAILED DESCRIPTION OF THE PREFERRED EMBODIMENTS

Figure 1A:
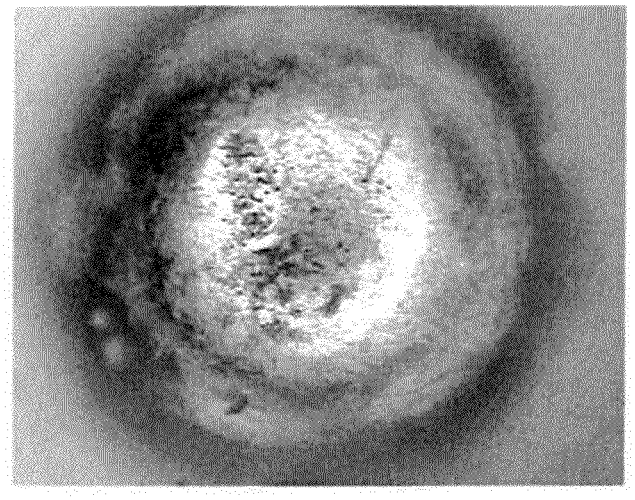
FIG. 1A(PRIOR ART)
FIG. 1A is a schematic view showing the surface of a connector with a conventional AuCo electrical contact material gone through an arc erosion test for 500 times.
Figure 1B:
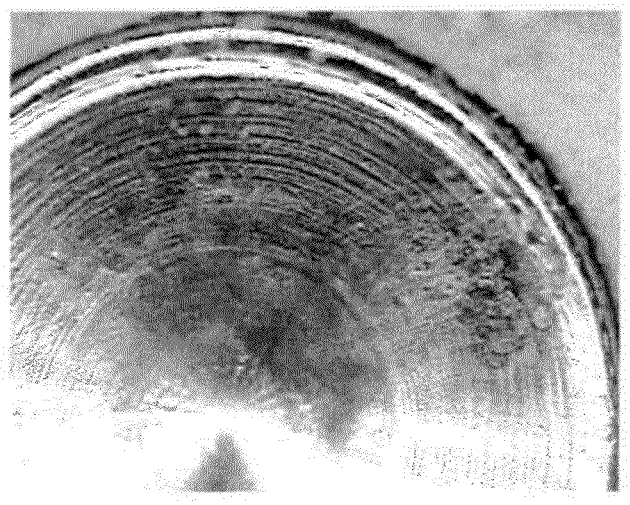
FIG. 1B(PRIOR ART)
FIG. 1B is another schematic view showing the surface of a connector with a conventional AuCo electrical contact material gone through an arc erosion test for 500 times.

The technical characteristics, effects and advantages of the present invention will be apparent with the detailed description of preferred embodiment together with the illustration of related drawings as follows.

Since current is forced to pass through a slightly conducted electrical contact at the moment when the electrical contact is disconnected, an electric arc effect occurs at a smaller area of the slightly conducted electrical contact, and the density of passing current is up to $5*10^4$ A/cm$^2$. Therefore, the temperature at the electrical contact rises rapidly to induce a strong magnetic field to accelerate the movement of electrons, anions or cations, so as to introduce a severe arc erosion effect. To reduce or eliminate the occurrence of such damage, an electrical contact material with a higher coefficient of electrical conductivity should be used, so that when the current is passed through, less heat energy is produced, and a softening effect caused by the high temperature and affecting the strength of the material can be avoided. If the electrical contact material comes with a better thermal conductivity, the heat at the electrical contact can be conducted and dissipated effectively to avoid damages of the material by overheat and reduce the influence caused by the electric arc effect. In addition, the electrical contact material is generally applied in an environment with various kinds of corrosive gases, so that the erosion resistance and oxidation resistance are necessary requirements of the electrical contact material. With the aforementioned requirements, the formation of electrically insulated compounds or oxides formed on the surface of the material and causing an increased contact resistance and a reduced lifespan of the material can be avoided. Mechanical wearing generally occurs at the moment of connecting or disconnecting an electrical contact, such that the surface of the electrical contact material will be worn out or damaged after a long time of use, and hardness or wear resistance is also one of the requirements of the electrical contact material.

However, a material with a higher hardness and a better wear resistance generally comes with a higher contact resistance, so that the present invention can provide an electrical contact material concurrently having the foregoing characteristics to meet the requirements and apply the electric contact materials in various different areas. The differences of physical property and arc erosion resistance between two materials disclosed in the present invention and a conventional electrical contact material are listed in the following table.

Testing Conditions 1~5A, 10~20 V

| Sample Type | Elements | Proportion | Hardness (Hv) | Contact Resistance (mohm) | Resistance ARC Damage (cycle) |
|---|---|---|---|---|---|
| AgSnIn alloy | Ag/$Sn_2O_3$/$In_2O$ | Ag-90%, ($SnO_2$ + $In_2O_3$)-9~11% | 100~110 | 5~60 | $2 \times 10^3$~$10 \times 10^3$ |
| AgCu alloy | Ag/$CuO_2$ | Ag-80%, Cu oxide-15~25% | 110~150 | 5~60 | $2 \times 10^3$~$10 \times 10^3$ |
| AuCo layer | Au/Co | Au-99.7%, Co-0.3% | 180~310 | 50~100 | $0.5 \times 10^3$ |

In the table above, the present invention provides an arc erosion resisting silver matrix containing no cadmium-composite electric contact material characterized in that the electrical contact material contains no toxic substance and complies with the specification set forth by the international directives by using a silver matrix with a higher coefficient of electrical conductivity or a better thermal conductivity. In the meantime, the electrical contact material has a Vickers hardness (Hv) up to 100~150 to meet the required wear resistance. In addition, the conventional material having a better hardness generally comes with an increased contact resistance, but such problem is improved in the electrical contact material of the present invention. In the table, two materials with a high hardness still maintain a low contact resistance at 5~60 milliohm (mohm). For example, the content of ($SnO_2$+$In_2O_3$) in an Ag—($SnO_2$+$In_2O_3$) composite is 9~11% or the content of Cu oxide in an Ag—Cu oxide composite is 15~25%. The addition of $SnO_2$ and $In_2O_3$ can improve the distribution effect and the mechanical property, wherein $SnO_2$ will not be decomposed easily at high temperature, and $SnO_2$ can enhance the viscosity of the material to protect the silver matrix and reduce a loss of volume of the silver matrix caused by the arc erosion. Compared with the conventional electrical contact material such as AuCo alloy, the hardness of the AuCo alloy is higher than the material of the present invention material, but the electrical resistance at the electric contact is increased to 50~100 milliohm (mohm) which will cause a severer damage to the material in the arc discharge process. The Vickers hardness mentioned here is measured by $Hv=1.584*P(Kg)/d^2(mm^2)$ in an experiment, wherein the value of P is obtained by a load, and the value of d is obtained by multiplying a loading time with a loading speed.

The arc erosion resistance capability of the two materials is up to $2*10^3$~$10*10^3$ times, compared with the arc erosion resistance capability of the conventional material that can achieve 500 times only, the invention can improve the lifespan of the product significantly, and the two electrical contacts maintain an arc erosion resisting capability at the condition of a low contact resistance when the electrical contact material is formed on a surface of a metal substrate of an electric connector. In experiments, a constant-distance single arc erosion test or a multiple arc erosion test is generally adopted for the arc erosion resistance test, and the constant-distance single arc behavior is different from the multiple arc erosion behavior. The latter is close to the damage measured by a simulation of the actual operation of the electrical contact. For example, the multiple arc erosion process includes continuously back-and-forth collision test of the arc erosion and the electrical contact. As to the former, a simpler and quicker research method is used to study the condition and process of the arc erosion. For example, a constant distance is maintained between a cathode and an anode, and electric discharge erosion with relatively concentrated energies is used for eroding the surface of the material while avoiding the mechanical contact damage.

Figure 2A:
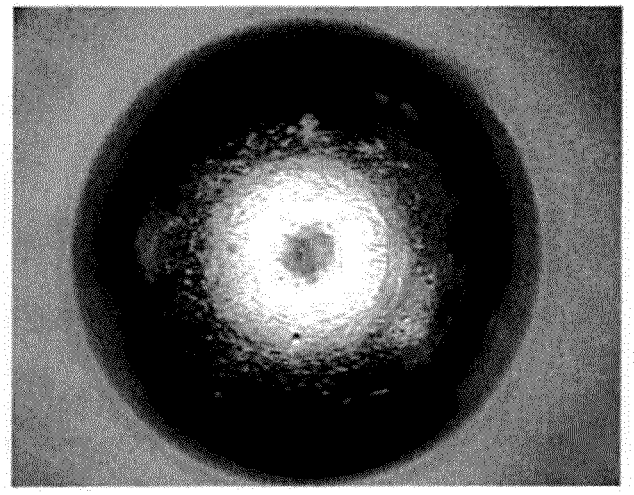
FIG. 2A is a schematic view showing the surface of a connector with an AgSnIn electrical contact material of the present invention gone through an arc erosion test for 5000 times.
Figure 2B:
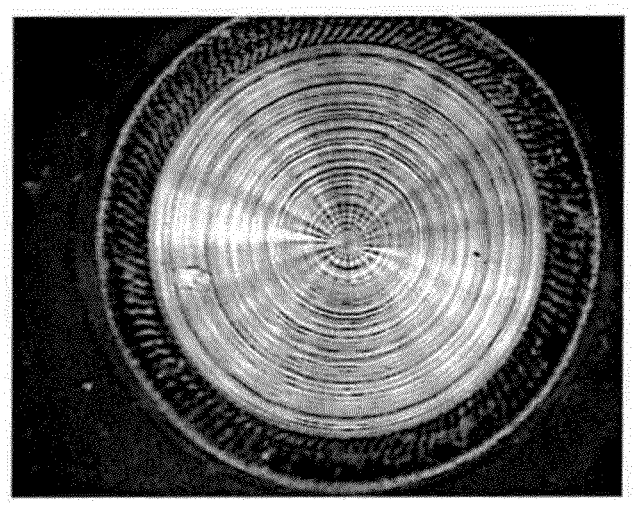
FIG. 2B is another schematic view showing the surface of a connector with an AgSnIn electrical contact material of the present invention gone through an arc erosion test for 5000 times.
Figure 3A:
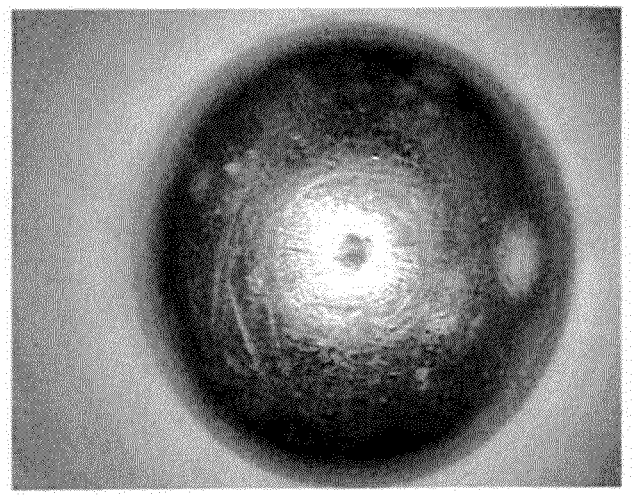
FIG. 3A is a schematic view showing the surface of a connector with an AgCu electrical contact material of the present invention gone through an arc erosion test for 2000 times.
Figure 3B:
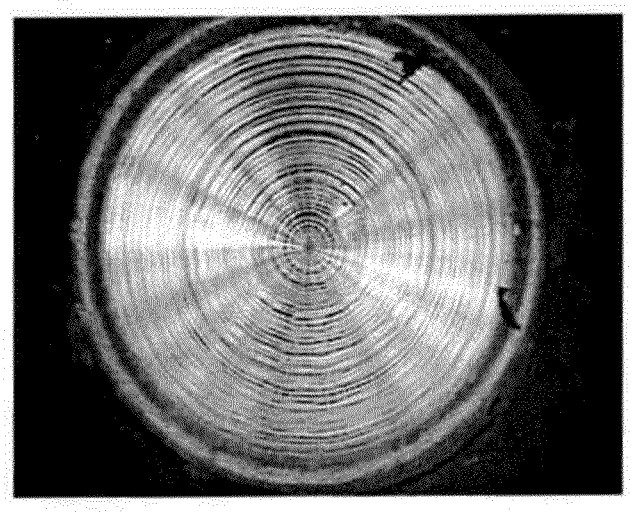
FIG. 3B is another schematic view showing the surface of a connector with an AgCu electrical contact material of the present invention gone through an arc erosion test for 2000 times.
Figure 4:
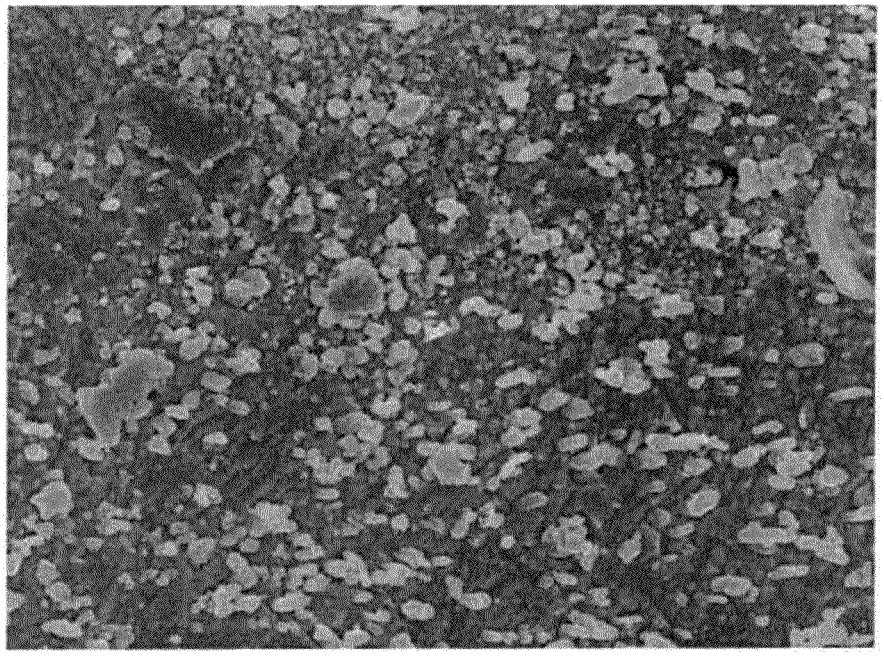
FIG. 4 is a scanning electron microscopy (SEM) photo of tissues of an electrical contact material of the present invention.

With reference to FIGS. 2A and 2B for schematic views showing the surface of a connector with an AgSnIn electrical contact material of the present invention gone through an arc erosion test for 5000 times and FIGS. 3A and 3B for schematic views showing the surface of a connector with an AgCu electrical contact material of the present invention gone through an arc erosion test for 2000 times, the electrical contact material of present invention still maintains its smoothness, integrity and hardness after the arc erosion tests take place. With reference to FIG. 4 for a SEM photo of tissues of the electrical contact material of the present invention, the cross-section viewed from the electronic microscope shows the properties of the added material of the present invention, and the added material can be distributed in the silver matrix uniformly to improve the distribution and mechanical wear resistance.

The present invention provides an arc erosion resisting silver matrix containing no cadmium-composite electric contact material and in compliance the Waste Electrical and Electronic Equipment and Restrictions of Hazardous substance (RoHS) directives set forth by the European Commission (EC), and the electrical contact material also has the capability of conducting a large current and the advantages of a better erosion resistance and an enhanced hardness of the contact material to achieve the effects of reducing the arc erosion effect, providing a low contact resistance, enhancing the lifespan of the product, and applying the material to products in different areas.

In summation of the above description, the present invention herein enhances the performance than the conventional structure and further complies with the patent application requirements and is duly filed for patent application.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. An electric contact material of a silver matrix capable of resisting arc erosion and containing no cadmium-composite, characterized in that the electrical contact material is comprised of an Ag—($SnO_2$+$In_2O_3$) composite, the Ag—($SnO_2$+$In_2O_3$) composite comprises 9-11% of ($SnO_2$+$In_2O_3$), the electrical contact material has a contact resistance of 5-60 milliohms (mohm) and an arc erosion resistance capability of $2*10^3$-$10*10^3$ times at the conditions of a Vickers hardness (Hv) of 100-150, a measured current of 1-5 amperes and a measured voltage of 10-20 volts, and two electrical contacts maintain an arc erosion resisting capability at the condition of a low contact resistance when the electrical contact material is formed on a surface of a metal substrate of an electric connector.

2. An electric contact material of a silver matrix capable of resisting arc erosion and containing no cadmium-composite, characterized in that the electrical contact material is comprised of an Ag—Cu oxide composite, the Ag—Cu oxide composite comprises 15-25% of Cu oxide, the electrical contact material has a contact resistance of 5-60 milliohms (mohm) and an arc erosion resistance capability of $2*10^3$-$10*10^3$ times at the conditions of a Vickers hardness (Hv) of 100-150, a measured current of 1-5 amperes and a measured voltage of 10-20 volts, and two electrical contacts maintain an arc erosion resisting capability at the condition of a low contact resistance when the electrical contact material is formed on a surface of a metal substrate of an electric connector.

* * * * *